US008955614B2

(12) United States Patent
Schoeps

(10) Patent No.: US 8,955,614 B2
(45) Date of Patent: Feb. 17, 2015

(54) PNEUMATIC POWER WRENCH WITH AN EXHAUST AIR OUTLET UNIT

(75) Inventor: Knut Christian Schoeps, Tyresö (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 759 days.

(21) Appl. No.: 13/259,660

(22) PCT Filed: Mar. 24, 2010

(86) PCT No.: PCT/SE2010/000070

§ 371 (c)(1),
(2), (4) Date: Sep. 23, 2011

(87) PCT Pub. No.: WO2010/110714

PCT Pub. Date: Sep. 30, 2010

(65) Prior Publication Data

US 2012/0024557 A1 Feb. 2, 2012

(30) Foreign Application Priority Data

Mar. 25, 2009 (SE) ..... 0900375

(51) Int. Cl.

| | |
|---|---|
| ***B25B 23/00*** | (2006.01) |
| ***B25B 23/151*** | (2006.01) |
| ***B25F 5/00*** | (2006.01) |
| ***B25B 21/00*** | (2006.01) |

(52) U.S. Cl.

CPC ..... *B25B 21/00* (2013.01)
USPC ..... 173/168; 173/93.5; 173/169; 181/230; 181/267

(58) Field of Classification Search

USPC ..... 173/168, 169, 170, 218, 93, 93.5; 181/222, 229, 230, 232, 238, 239, 252, 181/268, 267

See application file for complete search history.

(56) References Cited

U.S. PATENT DOCUMENTS

| | | | | |
|---|---|---|---|---|
| 3,299,781 | A * | 1/1967 | Law | 418/100 |
| 3,315,754 | A | 4/1967 | Holdo et al. | |
| 3,454,111 | A | 7/1969 | Niess | |
| 3,507,173 | A | 4/1970 | Wallace | |
| 3,561,561 | A * | 2/1971 | Trainor | 181/267 |
| 3,718,208 | A * | 2/1973 | Gibel | 181/267 |

(Continued)

FOREIGN PATENT DOCUMENTS

WO WO 2006/062522 A1 6/2006

OTHER PUBLICATIONS

International Search Report dated Jun. 4, 2010 issued in International Appln. No. PCT/SE2010/000070.

*Primary Examiner* — Scott A. Smith
(74) *Attorney, Agent, or Firm* — Holtz, Holtz, Goodman & Chick PC

(57) ABSTRACT

A portable pneumatic power wrench has a housing with a handle, a motor, a pressure air inlet passage, and an outlet passage for ducting exhaust air from the motor out of the housing. An outlet unit is connected to the outlet passage and has a first outlet opening section forming a main exhaust air flow path, a second outlet opening section forming an additional exhaust air flow path, and a manually operable valve arranged to control the additional exhaust air flow path by opening or closing the second outlet opening section. The total outlet flow area of the main exhaust air flow path and the additional exhaust air flow path gives an augmented torque output of the power wrench.

8 Claims, 3 Drawing Sheets

(56) References Cited

U.S. PATENT DOCUMENTS

| | | | | | |
|---|---|---|---|---|---|
| 3,791,459 | A | | 2/1974 | Workman, Jr. | |
| 3,924,961 | A | * | 12/1975 | Hess et al. | 415/32 |
| 4,205,732 | A | * | 6/1980 | Auerbach et al. | 181/230 |
| 4,258,798 | A | * | 3/1981 | Campbell et al. | 173/168 |
| 4,449,609 | A | * | 5/1984 | Stoll | 181/230 |
| 4,772,186 | A | | 9/1988 | Pyles et al. | |
| 4,778,015 | A | * | 10/1988 | Jacobsson | 173/169 |
| 5,500,494 | A | * | 3/1996 | Ligman | 181/230 |
| 5,901,794 | A | * | 5/1999 | Schoeps et al. | 173/93.5 |
| 6,135,213 | A | * | 10/2000 | Schoeps | 173/93.5 |
| 6,161,628 | A | * | 12/2000 | Liu | 173/168 |
| 6,923,272 | B2 | * | 8/2005 | Jansson et al. | 173/169 |
| 6,926,117 | B2 | * | 8/2005 | Sterling | 181/230 |
| 6,991,043 | B1 | * | 1/2006 | Chen | 173/169 |
| 7,040,414 | B1 | * | 5/2006 | Kuo | 173/179 |
| 7,216,739 | B2 | * | 5/2007 | Sterling | 181/230 |
| 7,325,627 | B2 | * | 2/2008 | Tanji | 173/169 |
| 7,373,992 | B2 | * | 5/2008 | Sterling et al. | 173/169 |
| 7,484,649 | B2 | * | 2/2009 | Schnell et al. | 227/130 |
| 2006/0053979 | A1 | | 3/2006 | Izumisawa | |

* cited by examiner

PNEUMATIC POWER WRENCH WITH AN EXHAUST AIR OUTLET UNIT

This application is a U.S. National Phase Application under 35 USC 371 of International Application PCT/SE2010/000070 filed Mar. 24, 2010.

FIELD OF THE INVENTION

The invention relates to a pneumatic power wrench having a housing, a motor, and an exhaust air outlet unit for ducting exhaust air from the motor out of the housing.

BACKGROUND OF THE INVENTION

A problem concerned with pneumatic power wrenches is to accomplish an increased output torque when occasionally needed, for instance to loosen screw joints which have get stuck by cross threading, corrosion, paint etc. and which therefore require an augmented torque to be loosened. Particularly when a screw joint has become stuck during tightening due misalignment or some damage on the screw joint parts the output torque level set on the power wrench will not always be enough to loosen the joint. In such cases an augmented torque output or bias action will be necessary to manage to loosen the screw joint.

In some previously described power wrenches an augmented output torque in the reverse direction has been accomplished by using a pneumatic motor designed so as to deliver a higher torque in the reverse direction than in the normal forward direction. This means that the torque available in the reverse direction for loosening difficult screw joints is higher than the normal tightening torque. However, a power wrench having such an asymmetric motor is disadvantageous in that it will provide a biased reverse action on one type of screw joints only, either right hand threaded or left hand threaded screw joints. Apart from that, such an asymmetric motor is less powerful in the tightening direction than a symmetric motor of the same size. Once designed for one type of screw joints, for instance right hand threaded screw joints, such an asymmetrically operating power wrench can not easily be altered to provide the same torque output relationship on left hand threaded screw joints. This means that there has to be available two different types of power wrenches for obtaining the same torque output characteristics, one for right hand threaded screw joints and another for left hand threaded screw joints. This is a cost related drawback not only for the power wrench supplier but also for the operator who has to have in possession two different types of power wrenches.

SUMMARY OF THE INVENTION

It is an object of the invention to provide a pneumatic power wrench by which an augmented torque or bias function is available in both directions of rotation of the power wrench motor.

Another object of the invention is to provide a pneumatic power wrench including an exhaust air outlet unit with a manually controlled additional flow path for accomplishing in a selective way an augmented torque output.

Still another object of the invention is to provide a pneumatic power wrench by which an augmented torque output is obtainable via an exhaust air outlet unit fitted to the power wrench as a piece of accessory.

Still another object of the invention is to provide an exhaust air outlet unit for a pneumatic power wrench, wherein the outlet unit has a first outlet opening means forming a main exhaust air flow path, and a second outlet opening means forming an additional exhaust air flow path which is selectively opened for accomplishing an augmented torque output.

Further objects and advantages of the invention will appear from the following drawings, description and claims.

A preferred embodiment of the invention is described below with reference to the accompanying drawings.

DETAILED DESCRIPTION

Figure 1:
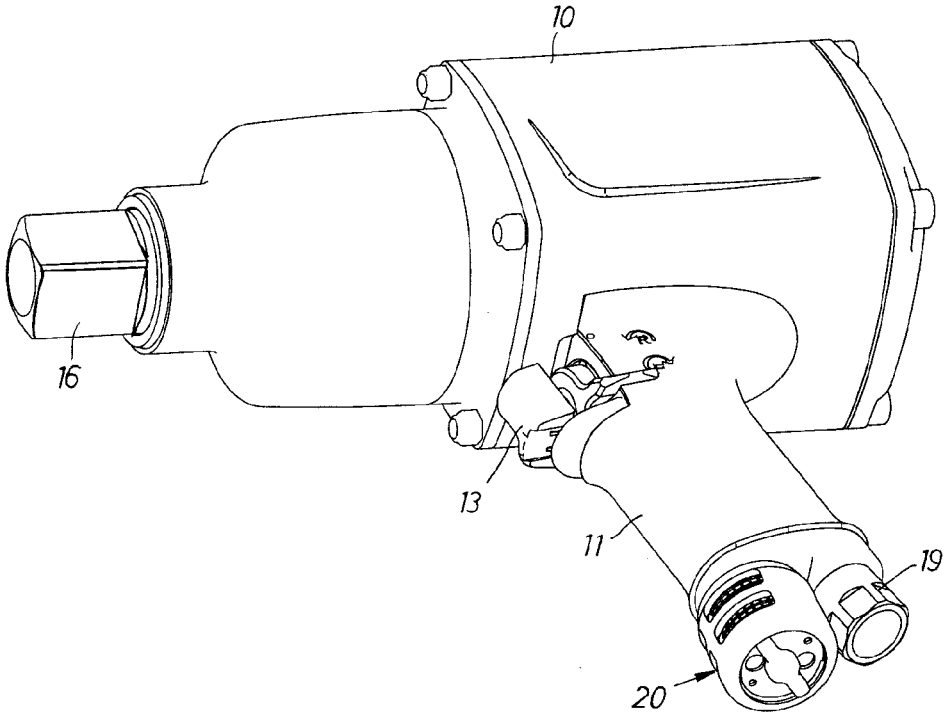
FIG. 1 shows a perspective view of a pneumatic power wrench according to the invention.
Figure 2:
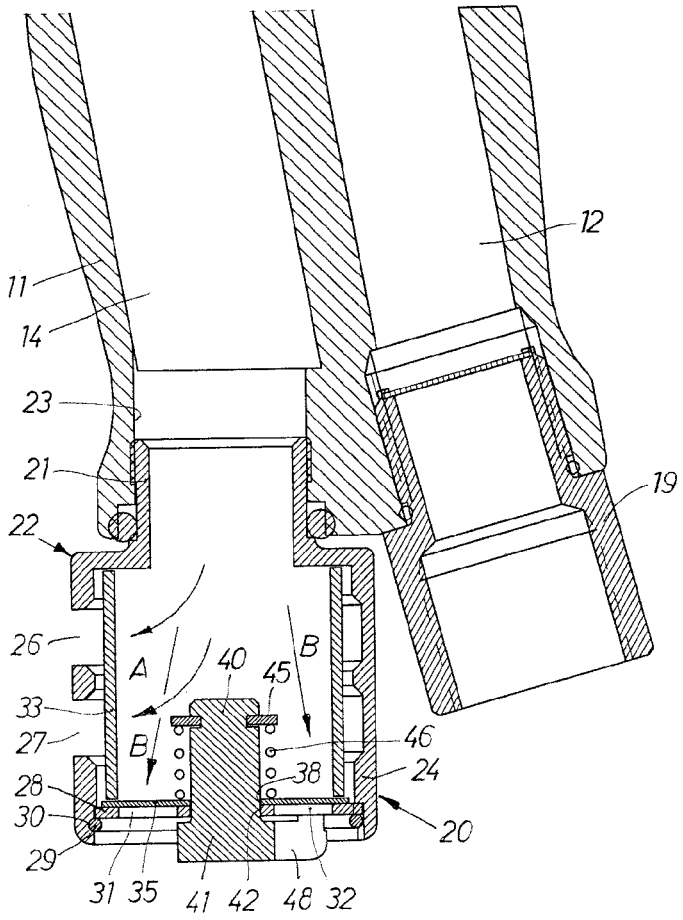
FIG. 2 shows a longitudinal section through a part of the power wrench handle.
Figure 5:
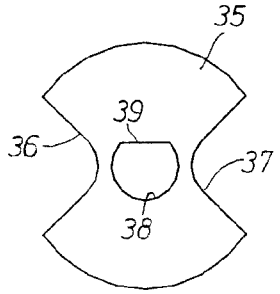
FIG. 5 shows a valve element.
Figure 4A:
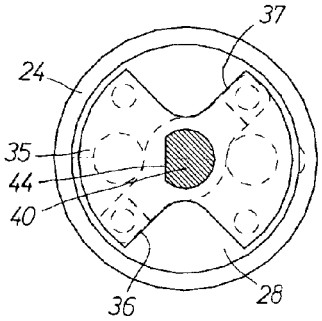
FIG. 4*a* shows a cross section along line A-A in the exhaust air outlet unit in FIG. 3*a*.
Figure 4B:
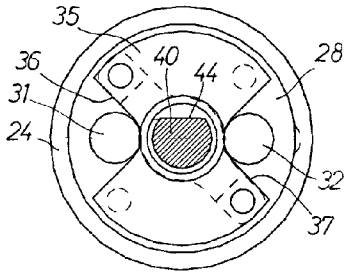
FIG. 4*b* shows a cross section along line B-B in FIG. 3*b*.
Figure 3A:
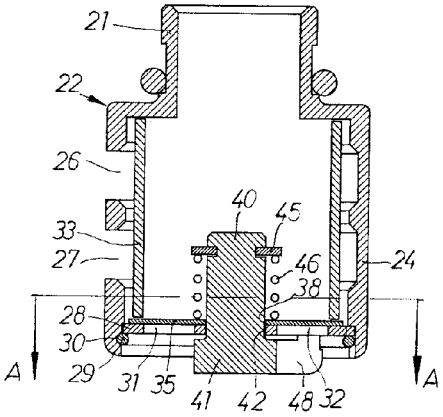
FIG. 3*a* shows a longitudinal section through an exhaust air outlet unit according to the invention illustrating a valve in closed position.
Figure 3B:
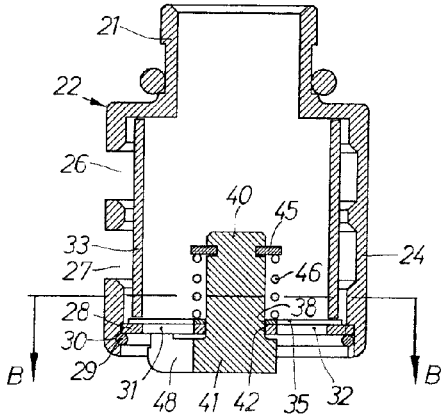
FIG. 3*b* shows the same section as in FIG. 3*a* but illustrating the valve in open position.

The pneumatic power wrench illustrated in the drawings comprises a housing 10 with a handle 11, a pressure air inlet passage 12 controlled by a throttle valve 13, an exhaust air outlet passage 14. A rotation motor in the housing 10 communicates with the pressure air inlet passage 12 and the exhaust air outlet passage 14 and is drivingly connected to an output shaft 16. At the lower end of the handle 11 there is mounted a connection piece 19 for a pressure air conduit, and an exhaust air outlet unit 20. The connection piece 19 communicates directly with the pressure air inlet passage 12, whereas the outlet unit 20 forms a direct continuation of the exhaust air outlet passage 14. See FIG. 2.

The outlet unit 20 comprises a cylindrical casing 22 with a threaded neck portion 21 received in a socket portion 23 of the outlet passage 14, a cylindrical envelope wall 24 provided with two lateral slot like openings 26, 27, and a flat transverse end wall 28. The end wall 28 is locked to the casing 22 by a piece of wire 29 inserted in a circumferential groove 30 in the wall 24 and comprises two circular openings 31, 32. Inside the cylindrical wall 24 there is provided a tubular sound damping insert 33 of a porous material, and a flat valve element 35 is arranged in sealing contact with the end wall 28. The valve element 35 has the form of a butterfly with two opposite V-shaped apertures 36, 37 and comprises a central part-circular opening 38. The opening 38 has a straight portion 39 for co-operation with a flat portion 44 on a stem 40 of a maneuver handle 41 to thereby rotatively lock the valve element 35 to the stem 40 of the maneuver handle 41. So, the valve element 35 is rotatable by the maneuver handle 41 between an open position, wherein the openings 31, 32 are left open by the V-shaped apertures 36, 37, and a closed position wherein the openings 31, 32 are covered.

The end wall 28 has a central opening 42 through which the stem 40 of the maneuver handle 41 extends. The stem portion 40 carries a flange forming ring element 45 at its inner end, and a spring 46 is supported between this ring element 45 and the valve element 35 so as to exert a bias force on the latter towards the end wall 28. This bias force is effective in providing a sealing engagement between the valve element 35 end the end wall 28 and at the same time retaining the maneuver handle 41 in place relative to the end wall 28.

The handle 41 comprises two wings 48 to be grasped by the operator when the valve element 35 is to be rotated and shifted between the open position and the closed position.

The lateral openings 26, 27 are always open and constitute a first outlet opening means of the outlet unit 20. This first outlet opening means formed by the openings 26, 27 form a main exhaust air flow path A, which is the regular exhaust air flow path through the outlet unit 20 during screw joint tightening processes. In this case the valve element 35 is in its closed position, i.e. the valve element 35 covers the openings 31, 32 in the end wall 28, thereby preventing exhaust air from leaving the outlet passage 14 through these openings. However, should an augmented output torque of the power wrench be required, usually in the reverse direction for loosening screw joints, the maneuver handle 41 is turned by the operator to make the valve element 35 rotate to the open position in which the apertures 36, 37 of the latter are aligned with the openings 31, 32. In this position of the valve element 35 there is opened up an additional exhaust air flow path B forming a second outlet opening means. This means that the total outlet flow area is significantly enlarged, and the exhaust air may leave the outlet passage 14 unrestricted which increases the output power of the motor and, hence, the available output torque.

Since the sound damping insert 33 does not cover the outlet openings 31, 32 the augmented torque output is obtained with an increased exhaust noise. This will make the operator to prefer the closed valve position and perform the screw joint tightening operations with the normal pre-set power output. Should the operator use the open valve position with the additional flow path B open and the augmented torque output as a normal setting he will not have access to any increased torque output should a difficult-to-loosen-case appear.

It is to be noted that the embodiments of the invention are not restricted to the above described example but may be freely varied within the scope of the claims.

The invention claimed is:

1. A pneumatic power wrench comprising:

a housing with a pressure air inlet passage and an exhaust air outlet passage;

a rotation motor; and an exhaust air outlet unit communicating with the outlet passage, wherein the outlet unit comprises:

a first outlet opening section forming a main exhaust air flow path, a second outlet opening section forming an additional exhaust air flow path, a manually operable valve arranged to control the additional exhaust air flow path by controlling said second outlet opening section, and a casing, wherein said second outlet opening section comprises at least one aperture in said casing, wherein the casing is cylindrical in shape and comprises a cylindrical wall and a transverse end wall, and said first outlet opening section is provided on the cylindrical wall, and said at least one aperture forming the second outlet opening section is provided on the end wall, and the valve element is provided at the end wall, wherein said manually operable valve comprises a valve element provided with at least one aperture, and said valve element is movable between (i) a fully open position at which said at least one aperture of the valve element is aligned with said at least one aperture of the casing, and (ii) a fully closed position at which said at least one aperture of the valve element is completely out of alignment with said at least one aperture of the casing, and wherein the end wall is flat and the valve element is flat and is provided on an inside of the end wall, and the manually operable valve further comprises a maneuver handle comprising a stem portion extending through a central opening in the end wall and is rotatively locked to the valve element.

2. The power wrench according to claim 1, wherein the outlet unit further comprises a sound damping insert cooperating only with the first outlet opening section.

3. The power wrench according to claim 2, wherein the outlet unit further comprises a separate part attached to the housing.

4. The power wrench according to claim 1, wherein the stem portion is provided with a flange at an inner end thereof, and a spring is supported between the valve element and said flange to exert a bias force on the valve element towards the end wall.

5. The power wrench according to claim 4, wherein the outlet unit further comprises a separate part attached to the housing.

6. The power wrench according to claim 1, wherein the outlet unit further comprises a separate part attached to the housing.

7. An exhaust air outlet unit for a pneumatic power wrench, comprising:

a casing which is attachable to a power wrench housing, wherein the casing comprises:

a first outlet opening section forming a main exhaust air flow path, a second outlet opening section forming an additional exhaust air flow path, and a manually operable valve arranged to control the additional exhaust air flow path by controlling said second outlet opening section, wherein the casing is cylindrical in shape and has a cylindrical wall and a transverse end wall, and the first outlet opening section is formed by apertures in the cylindrical wall, and the second outlet opening section is formed by apertures in the end wall, and the valve element is provided at the end wall, and wherein the end wall is flat, and the valve element is flat and provided on an inside of the end wall, and a maneuver handle is supported at the end wall, said maneuver handle comprising a stem portion extending through a central opening in the end wall and being rotatively locked relative to the valve element.

8. The exhaust air outlet unit according to claim 7, wherein said stem portion is provided with a flange at an inner end thereof, and the spring is supported between the valve element and said flange to exert a bias force on the valve element towards the end wall.

* * * * *